United States Patent [19]

Adams

[11] Patent Number: 4,747,167

[45] Date of Patent: May 31, 1988

[54] NON-SHIFTABLE TOILET SEAT ASSEMBLY

[76] Inventor: Harold D. Adams, P.O. Box 5546, Greenville, Miss. 38701

[21] Appl. No.: 945,503

[22] Filed: Dec. 23, 1986

[51] Int. Cl.[4] ..... A47K 13/00; A47K 17/00

[52] U.S. Cl. ..... 4/234; 4/235; 4/237; 4/661

[58] Field of Search ..... 4/235, 234, 236–240, 4/251, 661

[56] References Cited

U.S. PATENT DOCUMENTS

| | | | |
|---|---|---|---|
| 1,334,137 | 3/1920 | Delany | 4/239 |
| 2,955,296 | 10/1960 | Zapolski | 4/239 |
| 3,646,620 | 3/1972 | McCawley | 4/237 |
| 4,461,046 | 7/1984 | Adams | 4/235 |
| 4,519,105 | 5/1985 | Blanck | 4/251 X |
| 4,574,401 | 3/1986 | Nakajima | 4/251 |

*Primary Examiner*—Henry K. Artis

*Attorney, Agent, or Firm*—Fleit, Jacobson, Cohn & Price

[57] ABSTRACT

Impact absorbing bumpers are contoured to be seated on the supporting surfaces of toilet bowl rims in cross-sectional alignment therewith at angularly spaced locations before attachment to the underside of a toilet seat. The toilet seat when hingedly mounted on the toilet bowl is displaced to its lowered position for attachment to the seated bumpers by adjustable attaching means.

9 Claims, 2 Drawing Sheets

NON-SHIFTABLE TOILET SEAT ASSEMBLY

BACKGROUND OF THE INVENTION

This invention relates generally to toilet seat installations and in particular to improvements over the installation disclosed in my prior U.S. Pat. No. 4,461,046.

Conventional toilet seats hinged to a toilet bowl are supported in their lowered positions on the rim of the toilet bowl by at least two impact absorbing bumpers secured to the underside of the toilet seat. Such bumpers are not effective, however, to prevent horizontal shift of the toilet seat under load from its position in alignment with the toilet bowl opening. One method of preventing such shift according to my prior U.S. patent aforementioned, is to provide a special toilet seat configuration having a lip portion contoured to fit inside of the opening rim. Another method of preventing shift disclosed in my prior patent, involves use of special bumpers, replacing the conventional bumpers on the underside of a conventional type of toilet seat. The contoured lip portion in such case is provided on the bumpers.

A serious drawback in the use of the aforementioned special bumpers, resides in the misalignment that often occurs when installing the toilet seat assembly. Because of unavoidable variations in alignment between toilet seat and bowl rim for different toilet bowl configurations and/or installations, no precision mounting of the special bumpers on the toilet seat could accommodate all variations. Accordingly, the bumpers often are not properly seated on the rim of the toilet bowl so as to defeat the non-shift prevention purpose. No such bumper seating problem is, of course, associated with conventional bumpers.

It is therefore an important object of the present invention to provide a toilet seat assembly of economical cost and easy installation for commercial and/or residential use, wherein special impact absorbing bumpers are utilized to prevent horizontal shift without the installational misalignment and seating problems aforementioned.

SUMMARY OF THE INVENTION

In accordance with the present invention, toilet seat assemblies are provided with a set of detached bumpers having associated adjustable attaching means. The bumpers are elongated to cross-sectionally overlap the non-planar supporting surfaces of toilet bowl rims and are seated thereon for support of toilet seats before attachment. In certain embodiments special bumpers are also seated on the supporting surfaces of the toilet seats before attachment for support of cover lids. The undersurfaces of the bumpers are accordingly configured to conform to the supporting surfaces when cross-sectionally aligned therewith. According to certain embodiments, such undersurfaces are contoured by lip portions at opposite ends fitted against the internal and external sides of the bowl rim when the bumpers are seated theron.

With the bumpers firmly seated, the hingedly mounted toilet seat components are displaced to their lowered positions into contact with top surfaces of the bumpers for attachment to the undersides of such toilet seat components by the adjustable attaching means. The seated bumpers are angularly spaced from each other at desired locations when contacted for attachment. In the case of bumpers contoured to engage only the internal or the external side of the supporting surface, the angular spacing exceeds 90° to insure that horizontal shift is prevented in all directions.

The attaching means according to one embodiment is in the form of an adhesive coating on the top surfaces of the bumpers protectively covered by peelable strips. According to another embodiment, the attaching means includes pins projecting from the top surfaces of the bumpers to be respectively inserted into one hole of angularly spaced groups of holes formed in the toilet seat at the desired locations. According to other embodiments, combinations of both of the foregoing attaching means may be utilized.

Other objects and advantages of the invention will become subsequently apparent from the details of construction and operation as more fully hereinafter described and claimed, reference being had to the accompanying drawings forming a part hereof, wherein like numerals refer to like parts throughout.

BRIEF DESCRIPTION OF DRAWING FIGURES

DETAILED DESCRIPTION OF PREFERRED EMBODIMENTS

Figure 2:
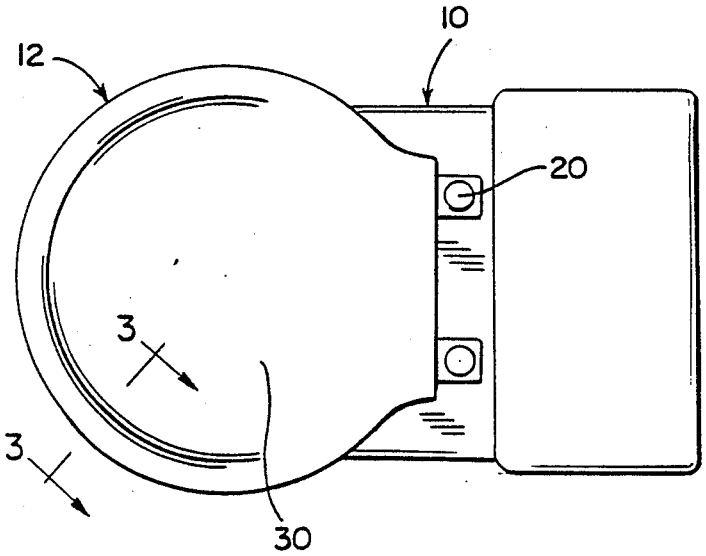
FIG. 2 is a top plan view of the installation shown in FIG. 1.
Figure 3:
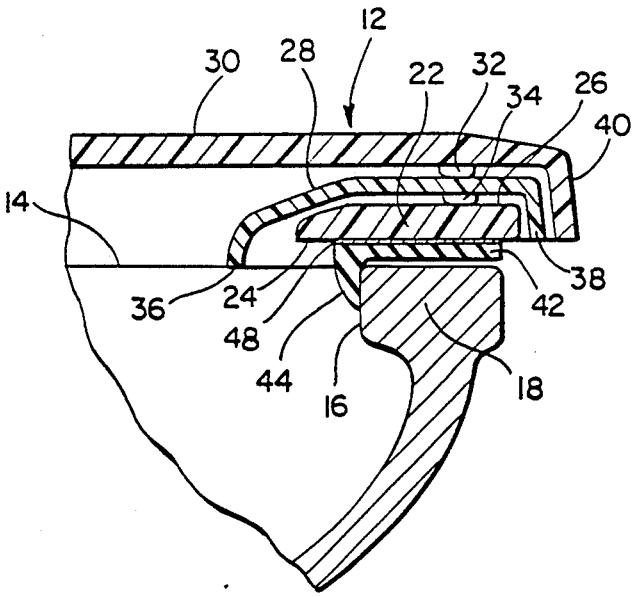
FIG. 3 is an enlarged partial section view taken substantially through a plane indicated by section line 3—3 in FIG. 2.

Referring now to the drawings in detail, FIGS. 2 and 3 illustrate a typical toilet bowl installation generally referred to by reference numeral 10 on which a toilet seat assembly 12 is mounted, the assembly 12 being constucted in accordance with one embodiment of the present invention. The toilet bowl 10 has an upper opening 14 defined by the internal surface 16 of an annular load supporting rim 18 having a non-planar cross-section as shown in FIG. 3. The opening 14 is closed by the toilet seat assembly 12 in its lowered position, as shown, to which it is pivotally displaced from a vertical retracted position about a fixed horizontal pivot axis established by a pair of hinge devices 20 in a manner already well known in the art.

The toilet seat assembly 12 in the embodiment shown in FIG. 3, includes a conventional adult size toilet seat component 22 having a flat annular undersurface 24 and an upper load supporting surface 26. The toilet seat 22 is mounted on the bowl by means of the hinges 20 which also pivotally mount a child size seat 28 and a cover lid 30. The child seat 28 is nested within the cover lid 30 as shown and is closely spaced from the cover lid and the toilet seat 22 by a plurality of spacers 32 and 34 respectively secured to the undersides of the cover lid and child seat. The child seat 28 has a downwardly curved radially inner rim portion 36 depending below the toilet seat 22 to define an opening that is dimensionally smaller than that of the adult toilet seat 22 so as to accommodate the seating of a child. Both the child seat 28 and cover lid 30 have radially outer flanges 38 and 40 enclosing the adult toilet seat 22.

The toilet seat assembly 12 in its lowered position as shown is supported on the bowl rim 18 by means of at least two, elongated bumpers 42 made of impact absorbent material. Attaching means is utilized to secure the bumpers 42 to the underside 24 of the adult toilet seat 22 in such a manner as to maintain substantial alignment between the bowl opening 14 and the toilet seat assembly, from which alignment relationship the bumpers prevent radial shift or horizontal displacement parallel to the plane of the opening. Each bumper 42 is therefore formed with a lip portion 44 depending from one end of the bumper into the opening 14 in the lowered portion of the adult toilet seat 22 to which it is attached for contact with the internal surface portion 16 of the rim. The underside of each bumper 42 thereby forms a contoured seating surface 46 conforming cross-sectionally to the rim 18 on which it is to be seated when it is longitudinally aligned with the rim cross-section on the underside of the toilet seat in the lowered position thereof.

Figure 1:
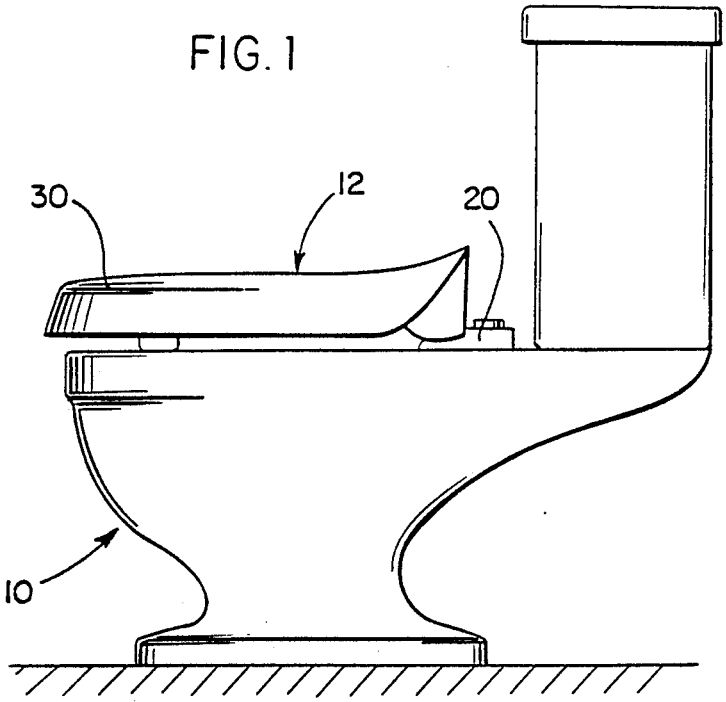
FIG. 1 is a side elevation view of a typical toilet bowl installation for the present invention.
Figure 4:
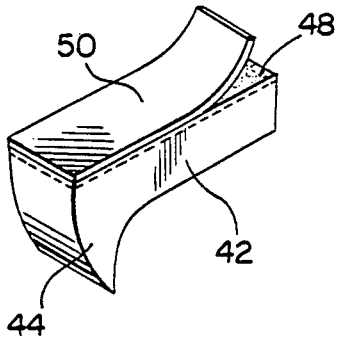
FIG. 4 is an perspective view of one of the bumpers utilized in the installation shown in FIG. 3.

In the embodiment shown in FIGS. 3 and 4, the attaching means for the bumpers 42 are formed by adhesive coatings 48 on top planar surfaces of the bumpers, adapted to be protectively covered by peelable plastic film strips 50. The toilet seat assembly 12 is therefore mounted on the toilet bowl by means of the hinge devices 20 before the bumpers 42 are attached. With the toilet seat assembly in its retracted position, the bumpers 42 are firmly seated at the desired locations on the rim 18 independently of the toilet seat assembly. The strips 50 are then peeled off to expose the adhesive coatings 48 after which the toilet seat 22 is displaced to its lowered position into contract with the adhesive coated surfaces of the bumpers 42.

Figure 5:
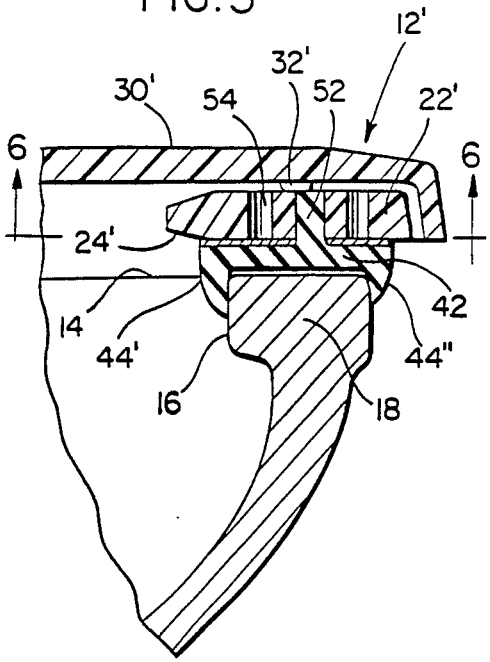
FIG. 5 is a partial section view similar to that of FIG. 3 showing another embodiment.
Figure 6:
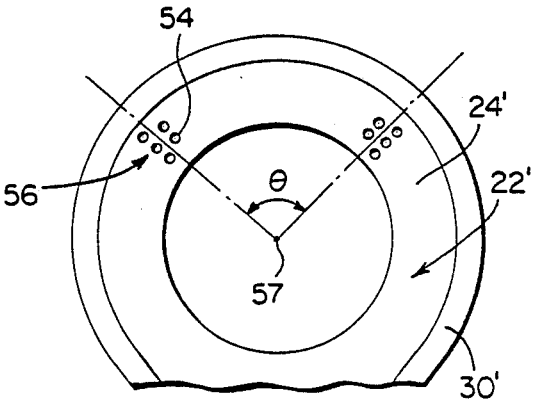
FIG. 6 is a partial section view taken substantially through a plane indicated by section line 6—6 in FIG. 5.

FIGS. 5 and 6 show another embodiment of the invention wherein a toilet seat assembly 12' consists of an adult toilet seat 22' and a cover lid 30' having spacers 32 adapted to engage the top supporting surface of the toilet seat 22'. Bumpers 42' are attached to the underside 24' of the toilet seat 22' in a manner similar to the attachment of bumpers 42 to seat 22 a hereinbefore described with respect to FIGS. 1–4. However, in addition to use of an adhesive coating 48, a pin or peg 52 projects from the top coated surface of each bumper into one of a plurality of holes 54 formed in the toilet seat. Such holes closely spaced from each other within two groups 56, are formed at locations angularly spaced from each other by an angle greater than 90° relative to the geometric center 57 of the opening 14, as shown in FIG. 6. The pins 52 interfitted in those holes 54 aligned therewith will more positively secure the bumpers to their positionally adjusted locations on the underside 24' of the toilet seat in its lowered and aligned position on the rim 18 of the toilet bowl. The cross-sectionally contoured undersurfaces 46' of the bumpers 42' are formed by lip portions 44' and 44'' at opposite ends as shown in FIG. 5 so as to be more firmly seated on the rim 18 before attachment to the underside of the toilet seat 22'. The lip 44'' contacts the exterior surface of the rim to more positively prevent horizontal shift during attachment to the toilet seat.

Figure 7:
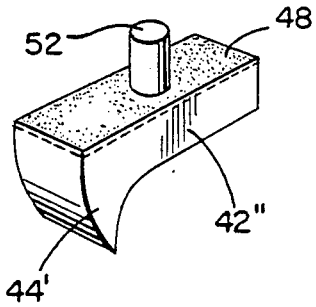
FIG. 7 is a perspective view of a modified form of bumper.
Figure 8:
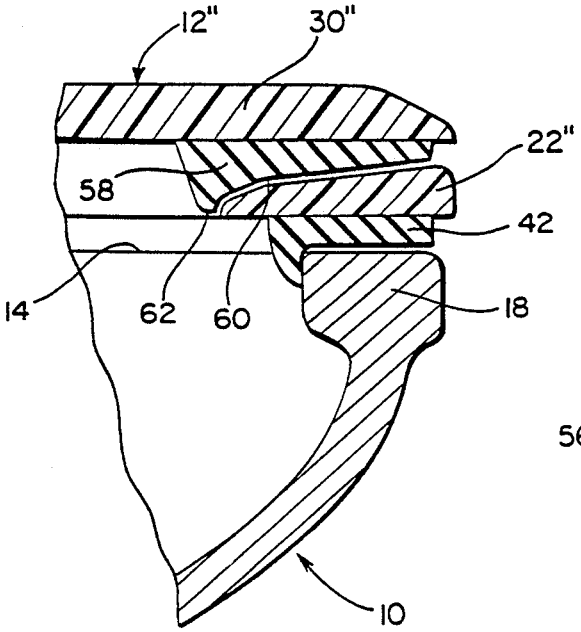
FIG. 8 is a partial section similar to that of FIGS. 3 and 5 showing yet another embodiment of the invention.

Bumpers 42'' having a single lip portion 44' and attachment pin 52, as shown in FIG. 7, may be used in place of the bumpers 42' shown in FIG. 5 or the bumpers 42 as shown in FIG. 8. The bumpers 42 that are shown attached to a toilet seat 22'' in FIG. 8 are associated with yet another embodiment featuring a toilet seat assembly 12'' having a cover lid 30'' without outer flanges to maintain alignment with the underlying toilet seat as in the case of FIGS. 3 and 5. Alignment is maintained instead by means of at least two additional bumpers 58 attached to the underside of the cover lid 30''. Each of the bumpers 58 has a lower contoured engagement surface 60 diverging inwardly from the flat undersurface of the cover lid to terminate at a lip 62 in contact with the inner rim of the toilet seat 22''. The toilet seat 22'' is therefore formed with an upper load supporting surface that converged inwardly toward the flat underside of the toilet seat for cross-sectional conformity with and contact by the bumpers 58 when the cover lid 30'' is lowered to its closed position over the toilet seat 22'' as shown in FIG. 8. The bumpers 58 not only space and support the cover lid 30'' on the toilet seat as a result of the foregoing configuration, but also function to prevent horizontal shift, as do the bumpers 42 with respect to the toilet seat 22 on the bowl rim 18. The bumpers 58 may be attached to the underside of cover lid 30'' by means and in a manner as hereinbefore described with respect to bumpers 42 and 42'.

The present invention contemplates and embraces toilet seat assemblies with as much as three components, such as the adult and child seats and a cover lid as shown in FIG. 3, two components consisting of a single toilet seat and a cover lid as shown in FIGS. 5 and 8, and a single toilet seat such as those shown in FIGS. 3, 5 and 8. In each case, a detached set of the bumpers 42, 42, 42'' and 58 are provided separately for adjustable attachment after the assembly is hingedly mounted on the toilet bowl, as hereinbefore described. Attachment may be made through either the adhesive coating 48 or the attachment pin 52, or a combination of both.

The bumpers 42, 42' or 42'' and 58 prior to attachment are seated on the load supporting surface of the toilet bowl rim 18 and in some cases also on the toilet seat, at locations angularly spaced by more than 90° relative to the geometric center 57 of the bowl opening 14 in order to prevent horizontal shift in any direction. Non-shiftable seating of the bumpers is achieved by longitudinal alignment thereof with a cross-sectional plane through the load supporting surface with which the contoured seating surface of the bumpers conform. The contoured seating surfaces on bumpers are formed on the undersides thereof between lip formations at opposite ends in the case of bumpers 42' to cross-sectionally overlap and embrace the rim 18 on internal and external sides.

From the foregoing, the construction and operation of the invention should be readily understood. Since numerous modifications and changes will readily occur to those skilled in the art, it is not desired to limit the invention to the exact construction shown and described, and accordingly all suitable modifications and equivalents may be resorted to, falling within the scope of the appended claims.

What is claimed is:

1. For use with a toilet bowl having a load supporting surface defining an opening, a toilet seat component having another load supporting surface and hinge means mounting the component on the toilet bowl for pivotal displacement to a lowered position in substantial alignment with said opening, a plurality of bumpers adapted to be seated on at least one of the load supporting surfaces, means for removably retaining the bumpers seated on said one of the load supporting surfaces in adjusted positions, the toilet seat component being displaceable to the lowered position thereof into engagement with the bumpers in said adjusted positions thereof, and means for attaching the bumpers to the toilet seat component in response to said engagement of the bumpers while in the adjusted positions seated on said one of the load supporting surfaces.

2. The combination of claim 1 wherein said adjustable attaching means further includes an adhesive coating on each of the bumpers and removable strips protectively covering the coatings prior to attachment.

3. For use with a toilet bowl having a load supporting surface defining an opening, a toilet seat component having another load supporting surface and hinge means mounting the component on the toilet bowl for pivotal displacement to a lowered position in substantial alignment with said opening, a plurality of bumpers adapted to be seated on at least one of the load supporting surfaces and means responsive to displacement of the toilet seat component to the lowered position thereof for adjustably attaching the bumpers thereto while seated on said one of the load supporting surfaces, said adjustable attaching means including a pin projecting from each of said bumpers and two groups of closely spaced holes formed in the toilet seat component, said two groups being angularly spaced from each other and respectively aligned with the bumpers while seated on said one of the load supporting surfaces to receive the projecting pins within one of the holes of each of the two groups.

4. The combination of claim 1 wherein the toilet bowl has an annular rim on which said one of the load supporting surfaces is formed, said toilet seat component being an annular seat on which the other of the load supporting surfaces is formed and having an underside on which the bumpers are mounted.

5. The combination of claim 4 including a cover lid hingedly connected to the annular seat and outer flange means connected to the cover lid in enclosing relation to the annular seat for maintaining operative alignment between the annular seat and the cover lid.

6. The combination of claim 1 wherein said toilet seat component is a cover lid, and an annular seat on which said one of the load supporting surfaces is formed in underlying relation to the cover lid.

7. The combination of claim 1 wherein said toilet seat component has an underside to which the bumpers are attached by said attaching means, each of said bumpers having a contoured surface cross-sectionally conforming to said one of the load supporting surfaces in nonparallel relation to the underside of the toilet seat component.

8. The combination of claim 7 wherein the toilet bowl has an annular rim on which said one of the load supporting surfaces is formed, said toilet seat component being an annular seat on which the other of the load supporting surfaces is formed.

9. The combination of claim 1 wherein said toilet bowl has an annular rim on which said one of the load supporting surfaces is formed, said means for removably retaining each of the bumpers seated on the rim comprising spaced lip portions projecting into contact with the rim both internally and externally of the toilet bowl.

* * * * *